United States Patent [19]

Iyer et al.

[11] Patent Number: 4,909,841

[45] Date of Patent: Mar. 20, 1990

[54] METHOD OF MAKING DIMENSIONALLY REPRODUCIBLE COMPACTS

[75] Inventors: Natraj C. Iyer, Monroeville; Alan T. Male, Murrysville Boro; William R. Lovic, New Kensington, all of Pa.

[73] Assignee: Westinghouse Electric Corp., Pittsburgh, Pa.

[21] Appl. No.: 374,330

[22] Filed: Jun. 30, 1989

[51] Int. Cl.[4] ..... C22C 29/12

[52] U.S. Cl. ..... 75/233; 75/232; 75/234; 75/235; 75/236; 75/237; 75/238; 75/240; 75/241; 75/243; 75/244; 75/246; 75/247; 75/249; 419/11; 419/12; 419/13; 419/15; 419/17; 419/18; 419/19; 419/21; 419/23; 419/25; 419/31; 419/33

[58] Field of Search ..... 75/232–238, 75/240, 241, 243, 244, 246, 247, 249; 419/11, 12, 13, 15, 17, 18, 19, 21, 23, 25, 31, 33, 38, 39, 48, 49, 57

[56] References Cited

U.S. PATENT DOCUMENTS 4,677,264 6/1987 Okumura et al. ..... 75/228

4,810,289 3/1989 Hoyen ..... 75/232

4,834,939 5/1989 Bornstein ..... 75/232

*Primary Examiner*—Stephen J. Lechert, Jr.

*Attorney, Agent, or Firm*—Daniel P. Cillo

[57] ABSTRACT

A process of hot pressing of materials to form articles or compacts is characterized by the steps: (A) providing a compactable particulate mixture; (B) uniaxially pressing the particles without heating to provide article or compact (22); (C) placing at least one article or compact (22) in an open pan (31) having an insertable frame (32) with edge surfaces (34) that are not significantly pressure deformable, where the inside side surfaces of the frame are parallel to the central axis B—B of the open pan, and where each article or compact is surrounded by fine particles of a separating material; (D) evacuating air from the container and sealing the articles or compacts inside the container by means of top lid (36); (E) hot pressing the compacts at a pressure from 352.5 kg/cm$^2$ to 3,172 kg/cm$^2$ to provide simultaneous hot pressing and densification of the articles or compacts; (F) gradually cooling and releasing the pressure; and, (G) separating the articles or compacts from the container, where there is no heating of the compacts in the process before step (E).

25 Claims, 2 Drawing Sheets

METHOD OF MAKING DIMENSIONALLY REPRODUCIBLE COMPACTS

BACKGROUND OF THE INVENTION

1. Field of the Invention

The present invention relates to a method for increasing dimensional stability, densification, void elimination and internal bonding between compactable particulates, preferably conductive and refractory constituents, within contact members used in switches, circuit breakers, and a wide variety of other applications.

2. Description of the Prior Art

Electrical contacts, used in circuit breakers and other electrical devices, contain constituents with capabilities to efficiently conduct high flux energy from arcing surfaces, while at the same time resist erosion by melting and/or evaporation at the arc attachment points. During interruption, where currents may be as high as 200,000 amperes, local current densities can approach $10^5$ amps/cm$^2$ at anode surfaces and up to $10^8$ amps/cm$^2$ at cathode surfaces on contacts. Transient heat flux can range up to $10^6$ KW/cm$^2$ at arc roots, further emphasizing the demand for contact materials of the highest thermal and electrical conductivity, and either silver or copper is generally selected. Silver is typically selected in air break applications, where post-arc surface oxidation would otherwise entail high electrical resistance on contact closure. Copper is generally preferred where other interrupting mediums (oil, vacuum or sulfur hexafluoride) preclude surface oxidation.

Despite the selection of contact metals having the highest conductivity, transient heat flux levels such as that previously mentioned, result in local surface temperatures far exceeding the contact melting point (962° C. and 1083° C. for silver and copper, respectively), and rapid erosion would result if either would be used exclusively. For this reason, a second material, generally graphite, or a high melting point refractory metal such as tungsten or molybdenum, or a refractory carbide, nitride and/or boride, is used in combination with the highly conductive metal to retard massive melting.

Conventional contact production processes generally involve blending powdered mixtures of high conductivity and high melting point materials, and pressing them into contacts, which are then thermally sintered in reducing or inert gas atmospheres. After sintering, the contacts are then infiltrated with conductive metal, which involves placing a conductive metal "slug" onto each contact and heating it in a reducing (or inert) gas atmosphere, this time above the conductor's melting point. The contacts may then be re-pressed, to increase density to levels of 96% to 98% of theoretical and then post-treated for final installation into the switching device.

These approaches have several disadvantages, in that they have limited process versatility, consist of numerous process steps resulting in a high cost operation, and have a limitation in the achievable densities and performance characteristics. U.S. Pat. No. 4,810,289 (N. S. Hoyer et al.) solved many of these problems, by utilizing highly conductive Ag or Cu, in mixture with CdO, W, WC, Co, Cr, Ni, or C, and by providing oxide clean metal surfaces in combination with a controlled temperature, hot isostatic pressing operation. There, the steps included cold, uniaxial pressing; canning the pressed contacts in a container with separating aid powder; evacuating the container; and hot isostatically pressing the contacts.

The Hoyer et al. process provided full density, high strength contacts, with enhanced metal-to-metal bonds. Such contacts had minimal delamination after arcing, with a reduction in arc root erosion rate. However, such contacts suffered from volumetric shrinkage during processing. What is needed is a method to provide dimensionally predictable and reproducible contacts which would shrink, if at all, only in one direction during processing, while still maintaining high strength, resistance to delamination, and enhanced metal-to-metal bonding characteristics. It is a main object of this invention to provide a method of making such superior contacts.

SUMMARY OF THE INVENTION

With the above object in mind, the present invention most generally resides in a method of forming a pressed, dense article characterized by the steps: (1) providing a compactable particulate combination; (2) uniaxially pressing the particulate combination to a theoretical density of from 60% to 95%, to provide a consolidated article having the length and width desired in the final article but with the height larger than desired in the final article; (3) placing at least one article in an open pan having a bottom surface and containing side surfaces that are not significantly pressure deformable, which side surfaces are parallel to the central axis of the pan, where the article is placed such that its height direction is parallel to the central axis of the pan, and where the article contacts a separation material which aids subsequent separation of the article and the pan; (4) evacuating air from the pan and sealing the open top portion of the pan, where at least one of the top and bottom surfaces of the pan is pressure deformable; (5) hot pressing the article through the sealed pan in the height direction of the article, where the pan side surfaces prevent significant lateral deformation of the article, at a pressure over 352.5 kg/cm$^2$ (5,000 psi), to provide simultaneous hot-pressing and densification of the entire article; (6) cooling and releasing pressure on the compact; and (7) separating the densified article from the pan.

The present invention also resides, more specifically, in a method of forming a pressed, dense, dimensionally predictable and reproducible metal compact, characterized by the steps: (1) mixing: (a) powders selected from Class 1 metals consisting of Ag, Cu, Al, and mixtures thereof, with (b) powders selected from the class of CdO, SnO, $SnO_2$, C, Co, Ni, Fe, Cr, $Cr_3C_2$, $Cr_7C_3$, W, WC, $W_2C$, WB, Mo, $Mo_2C$, MoB, $MO_2B$, TiC, TiN, $TiB_2$, Si, SiC, $Si_3N_4$, and mixtures thereof; (2) uniaxially pressing the powders to a theoretical density of from 60% to 95%, to provide a compact having the length and width desired in the final compact but with the height larger than desired in the final compact; (3) placing at least one compact in an open pan having a bottom surface, and containing side surfaces that are not significantly pressure deformable, which side surfaces are parallel to the central axis of the pan, where the compact is placed such that there are no significant gaps between the compact and the side surfaces, and the compact's height direction is parallel to the central axis of the open pan, and where the compact contacts a separation material which aids subsequent separation of the compact and the pan; (4) evacuating air from the pan and sealing the open top portion of the pan, where at least one of the top and bottom surfaces of the pan is pressure deformable; (5) hot pressing the compact through the sealed pan in the height direction of the compact, where the pan side surfaces prevent significant lateral deformation of the compact, at a pressure between 352.5 kg/cm$^2$ (5,000 psi) and 3,172 kg/cm$^2$ (45,000 psi) to provide simultaneous hot-pressing and densification of the entire compact to over 97% of theoretical density; (6) cooling and releasing pressure on the compact; and (7) separating the compact from the pan.

This combination of: using a pan container with essentially non-deformable sides, disposing the compact(s) on the pan so that the axis along their height direction is parallel to the central axis of the pan, and simultaneous pressing along the compact(s) height axis and heating, results in dimensionally predictable and reproducible compacts. This compact can be used as a contact or heat sink in electronic or electrical equipment, and as a composite, for example a contact layer bonded to a highly electrically conductive material of, for example copper and the like. The prime powders for contact use include Ag, Cu, CdO, SnO, $SnO_2$, C, Co, Ni, Fe, Cr, $Cr_3C_2$, $Cr_7C_3$, W, WC, $W_2C$, WB, Mo, $Mo_2C$, MoB, and TiC. The prime powders for heat sink use include Al, TiN, $TiB_2$, Si, SiC, and $Si_3N_4$. The term "powders" is herein meant to include spherical, fiber and other particle shapes.

The process is further characterized in that the preferred height or thickness of the article or compact before hot final pressing is approximately the desired final compact height divided by the percent of theoretical density of the compact. The process is also further characterized in that the preferred container comprises an open top, thin wall, very shallow pan, having a closely fitting, metal, ceramic, or graphite frame disposed next to the sides of the pan, which frame sides are parallel to the central axis of the pan and act to prevent significant lateral deformation of the compacts during hot pressing. A top lid is fitted over the pan and air evacuated. Then the lid and pan are sealed along their edges. Hot pressing can be accomplished in an isostatic press if desired, which, although such a press will be ineffective to exert significant lateral pressure on the compacts due to the frame, may provide certain practical advantages.

BRIEF DESCRIPTION OF THE DRAWINGS

In order that the invention can be more clearly understood, convenient embodiments thereof will now be described, by way of example, with reference to the accompanying drawings in which:

FIG. 2 is a cross-sectional view of three types of compact articles, showing their height axes.

DESCRIPTION OF THE PREFERRED EMBODIMENTS

Figure 1:
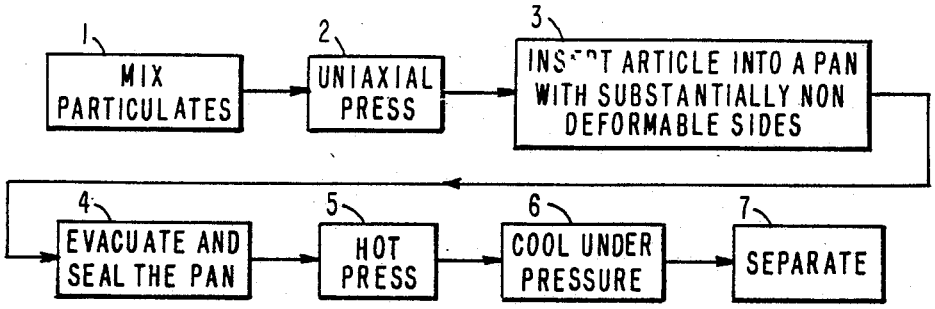

Referring now to FIG. 1 of the Drawings, compactable particulate combinations of materials, such as powders, are provided or mixed in step 1. In the particulate combination step, in most instances, simple powder mixing is adequate, but in some instances alloys may be formed, which alloys may be oxidized or reduced, and then formed into particles suitable for compacting. The usual step is a powder mixing step. Useful powders include many types, for example, a first class, "Class 1" selected from highly conductive metals, such as Ag, Cu, Al, and mixtures thereof, most preferably Ag and Cu. These can be mixed with other powders from a class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$ and mixtures thereof, most preferably CdO, SnO, W, WC, Co, Cr, Ni and C. The mixture of Al with TiN, $TiB_2$, Si, SiC and $Si_3N_4$ is particularly useful in making articles for heat sink applications. The other materials are especially useful in making contacts for circuit breakers and other electrical switching equipment.

When the article to be made is a contact, the Class 1 powders can constitute from 10 wt.% to 95 wt.% of the powder mixture. Preferred mixtures of powders for contact application, by way of example only, include Ag+W; Ag+CdO; Ag+$SnO_2$; Ag+C; Ag+WC; Ag+Ni; Ag+Mo; Ag+Ni+C; Ag+WC+Co; Ag+WC+Ni; Cu+W; Cu+WC; and Cu+Cr. These powders all have a maximum dimension of up to approximately 1,500 micrometers, and are homogeneously mixed.

The powder, before or after mixing, can optionally be thermally treated to provide relatively clean particle surfaces, after step 1 of FIG. 1. This usually involves heating the powders at between approximately 450° C., for 95 wt.% Ag+5 wt.% CdO, and 1,100° C., for 10 wt.% CU+90 wt.% W, for about 0.5 hour to 1.5 hours, in a reducing atmosphere, preferably hydrogen gas or dissociated ammonia. This step can wet the materials and should remove oxide from the metal surfaces, yet be at a temperature low enough not to decompose the powder present. This step has been found important to providing high densification when used in combination with hot pressing later in the process. Where minor amounts of Class 1 powders are used, this step distributes such powders among the other powders, and in all cases provides a homogeneous distribution of Class 1 metal powders If the particles have been thermally cleaned, they are usually adhered together. So, they are granulated to break up agglomerations so that the particles are in the range of from 0.5 micrometer to 1,500 micrometers diameter. This optional step can take place before step 3 and after optional thermal cleaning. The mixed powder is then placed in a uniaxial press die. If automatic die filling is to be utilized, powders over 50 micrometers have been found to have better flow characteristics than powders under 50 micrometers. The preferred powder range for most pressing is from 200 micrometers to 1,000 micrometers.

Optionally, in some instances, to provide a brazeable or solderable surface for the contact, a thin strip, porous grid, or the like, of brazeable metal, such as a silver-copper alloy, or powder particles of a brazeable metal, such as silver or copper, may be placed above or below the main contact powder mixture in the press die. This will provide a composite type structure.

The material in the press is then uniaxially pressed in a standard fashion, without any heating or sintering, a step 2 of FIG. 1, at a pressure effective to provide a handleable "green" compact, usually between 35.25 kg/cm$^2$ (500 psi) and 2,115 kg/cm$^2$ (30,000 psi). This provides a compact that has a density of from 60% to 95% of theoretical. It may be desirable to coat the press with a material which aids subsequent separation of the compacts from the press, such as loose particles and/or a coating of ultrafine particles such as ceramic or graphite particles having diameters, preferably, between 1 micrometer and 5 micrometers diameter.

Figure 2A:
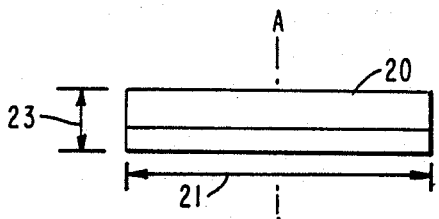
FIG. 2 is a block diagram of the method of this invention.
Figure 2B:
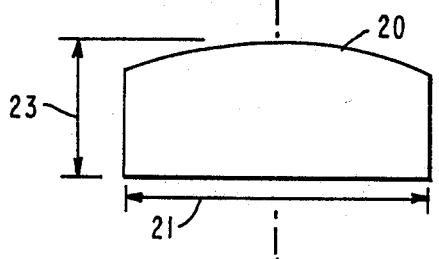
Figure 2C:
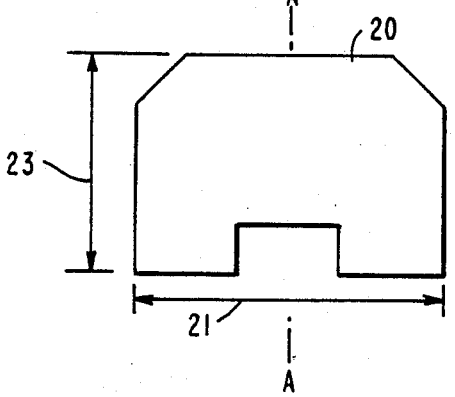

A variety of articles or compacts that may result are shown in FIG. 2. These compacts 20 have a length 21, and height or thickness 23, a height axis A—A, and top and bottom surfaces. The top surface can be flat, and, for example, have a composite structure as when a brazeable layer is disposed on the bottom of the contact as shown in FIG. 2(A). The article or compact can also have a curved top, which is a very useful and common shape, or a bottom slot, as shown in FIGS. 2(B) and 2(C) respectively. In some instances there can be a composition gradient, where, for example, a composition or a particular metal or other powder may be concentrated at a certain level of the article or compact. A useful medium-size contact would be about 1.1 cm long, 0.6 cm wide, and have a beveled top with a maximum height of about 0.3 cm to 0.4 cm.

After uniaxial pressing to from 60% to 95%, the resulting compact should have the length, and width dimensions desired in the final cooled, hot pressed compact, but the height or thickness dimension, that is, the side between the top and bottom surfaces, should be larger than desired in the final compact. The preferred height of the compact before hot final pressing is approximately equal to the desired, final compact height divided by the percentage of theoretical density of the compact after uniaxial pressing. The method of this invention can produce compacts very close to 100% density; that is, about 99.5% dense to 99.8% dense. So, for example, if the final, desired compact height is 10.0 mm, and the density of the compact after the first, cold uniaxial pressing is 75% of theoretical density, then the height of the compact before hot final pressing should be left about 10.0 mm/0.75 or 13.33 mm; that is, about 3.33 mm larger than the desired, approximately 100% dense, 10.0 mm desired final height.

The articles or compacts will be coated with a separation or parting material which does not chemically bond to the articles or compacts. In step 3 of FIG. 1, all the articles or compacts are placed in a pan for hot pressing. The articles or compacts are preferably placed in the pan with all their height directions; that is, height axes A—A in FIG. 2, parallel to each other. The pan will have side surfaces that are not significantly pressure deformable, and the inside portions of which are parallel to the central axis, B—B in FIG. 3, of the pan. The articles or compacts will have their height axes A—A parallel to the central axis of the pan, which will also be parallel to the top-to-bottom, substantially nondeformable inside, side surfaces of the container.

At least one surface of the pan, after sealing, will be pressure deformable and perpendicular to the height axes A—A of the articles or compacts. This pan-type container, in one embodiment, can be a one-piece, very shallow, metal canning pan having an open top end, thick metal sides that are not significantly pressure deformable and a thin bottom that is deformable, with a thin closure lid that is also deformable. Pressure can thus be exerted on the bottom and the closure lid, which in turn apply pressure to the compacts along their height axes A—A, the not significantly pressure deformable side surfaces of the pan being effective to prevent significant lateral deformation of the compacts and minimize lateral strains, thus preventing undesirable, uncontrolled heat-pressure volume shrinkage. In the method of this invention, pressure is directly exerted only along the height axes A—A of the articles or compacts, which is the direction the articles or compacts are pressed to a dimension greater than the final desired thickness. Exerting pressure in this uniaxial fashion will still press the articles or compacts to close to 100% of theoretical density if desired.

Figure 3:
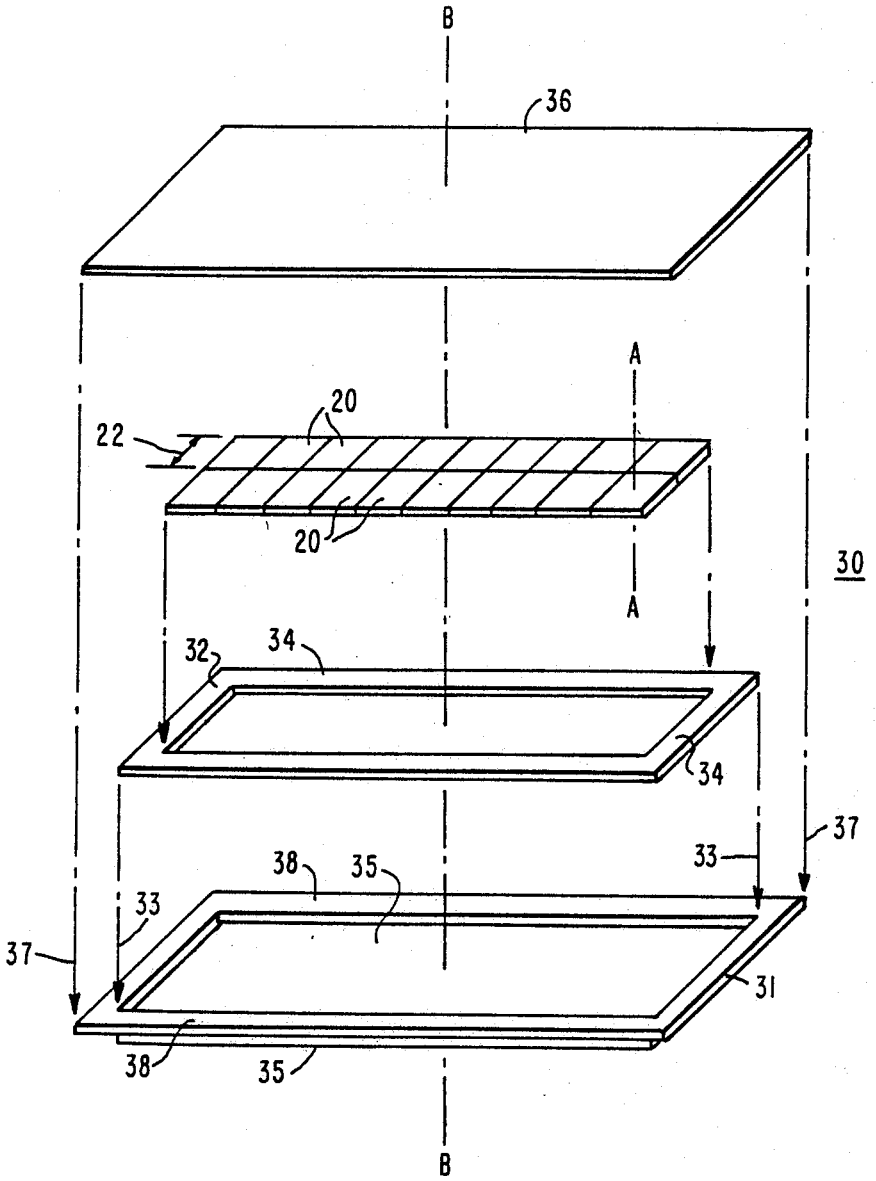
FIG. 3 is a three dimensional view of the most preferred canning components, showing a very shallow, open top pan having thin side walls and bottom surface, with an insertable, thick frame which closely fits next to the pan side walls.

FIG. 3 shows one type of preferred canning pan stack-up 30. The stack-up 30 comprises an open top, very shallow, pan 31, having a thin wall bottom surface 35, inner sides parallel to the central axis B—B of the pan container, and flat pan edges 38. The pan allows a separate, insertable, closely fitting, high temperature stable, metal, ceramic, graphite, or other type frame 32, to be disposed next to the inner sides of the pan 31, as shown by arrows 33. The edges 34 of the frame 32 are usually thick, to make the sides not significantly pressure deformable, i.e., having very little or no lateral pressure transmission. The frame 32 has an open top and bottom as shown, and its sides, in the up-and-down direction, are disposed parallel to the central axis B—B of the container. Preferably, the frame is of a one piece construction, such as stainless steel welded at the corners.

The pan 31 can be made of thin gauge steel, and the like high temperature stable material. The frame 32 can be made of alumina, heavy gauge steel, stainless steel, and a variety of alloys, such as, cobalt alloy, nickel-chrome alloy, titanium alloy, molybdenum alloy, tantalum alloy, niobium alloy, and the like. When the frame 22 is placed inside the pan 31, a plurality of compacts, such as 20, can be stacked inside the frame 32 on the thin wall bottom surface 35 of the pan. While only one layer of articles or compacts are shown in FIG. 3, it is possible to press multiple layers in the same pan, with interposed pressure transmitting separation or parting material between layers.

As shown, the axes A—A of the compacts will be parallel to the central axis B—B of the container. Also, as shown, all the articles or compacts are close packed so that there are no significant gaps between the articles or compacts and the inside, side surfaces of the frame. A thin wall top lid 36 is fitted over the pan and frame as shown by arrows 37, air is evacuated, and the top lid 36 is sealed to the pan 31 at the pan edges 38, such as by welding, or the like, to provide a top surface for the pan. The sealing can be accomplished in a vacuum container, thus combining the steps of sealing the lid and evacuating the pan. As an alternative to an insertable frame 32, the pan itself can have integral, thick, edges to provide sides which are not significantly pressure deformable.

Each pan can accommodate as many as 1,000 side-by-side articles or compacts, and a plurality of sealed pans can be stacked together to be hot pressed simultaneously. As shown in FIG. 3, eighteen large, flat articles or compacts are to be inserted into the pan 31. Usually, at least twelve articles or compacts will be simultaneously hot pressed. Pressure effective to densify the articles or compacts will be applied to the pan bottom surface 35 and top lid surface 36, both of which are preferably pressure deformable, in at least a uniaxial direction, with forces parallel to the axes A—A of the compacts and B—B of the pan.

In the container, each compact is surrounded by a material which aids subsequent separation of compact and pan material, as mentioned previously, such as loose particles, and/or a coating of ultrafine particles, and/or high temperature cloth. The separation material is preferably in the form of a coating or loose particles of ceramic, such as alumina or boron nitride, or graphite, all preferably between 1 micrometer and 5 micrometers diameter. The air in the container is evacuated and the container sealed, step 4 of FIG. 1.

The canned compacts are then placed in a hot press chamber, step 5. A uniaxial press can be used. If desired, an isostatic press can be used in place of the uniaxial press, where, for example, argon or other suitable gas is used as the medium to apply pressure to the container and through the container to the canned compacts. The non-deformable sides of the container will, as previously described, defeat part of the purpose of the isostatic press, since lateral pressure will not be fully transmitted to the compacts. However, an isostatic press may have certain control characteristics, such as uniformity in temperature and pressure, or other advantages making it useful here, even if it is only effective to transmit uniaxial pressure on the compact.

Pressure in the hot press, step 5, is over approximately 352.5 kg/cm$^2$ (5,000 psi), preferably between 352.5 kg/cm$^2$ (5,000 psi) and 3,172 kg/cm$^2$ (45,000 psi) and most preferably between 1,056 kg/cm$^2$ (15,000 psi) and 2,115 kg/cm$^2$ (30,000 psi). Temperature in this step is preferably from 0.5° C. to 100° C., preferably from 0.5° C. to 20° C., below the melting point or decomposition point of the lower melting point component of the article or compact such as the powder constituent, or, the strip of brazeable material if such is to be used, as described previously, preferably to provide simultaneous collapse of both the top and bottom of the pan, and through their contact with the compacts, hot-pressing of the articles or compacts, and densification through the pressure transmitting top and bottom of the pan, to over 97%, preferably over 99.5%, of theoretical density.

Residence time in step 5 can be from 1 minute to 4 hours, most usually from 5 minutes to 60 minutes. As an example of this step, where a 90 wt.% Ag+10 wt.% CdO powder mixture is used, the temperature in the press step will range from about 800° C. to 899.5° C., where the decomposition of CdO for the purpose of this application and in accordance with the *Condensed Chemical Dictionary,* 9th Edition, substantially begins at about 900° C. Controlling the temperature during this pressing step 5 is essential in providing a successful process that eliminates the infiltration steps often used in processes to form electrical contacts.

The hot pressed articles or compacts are preferably then gradually brought to room temperature and one atmosphere of pressure over an extended period of time, in block 6 of FIG. 1, usually 2 hours to 10 hours. This gradual cooling under pressure is important, particularly if a compact with a composition gradient is used, as it minimizes residual tensile stress in the component layers and controls warpage due to the differences in thermal expansion characteristics. Finally, the articles or compacts are separated from the pan which has collapsed about them, block 7.

Contact compacts made by this method have, for example, enhanced metallurgical bonds leading to high arc erosion resistance, enhanced thermal stress cracking resistance, and can be made substantially 100% dense. In this process, there is no heating of the pressed articles or compacts before the hot pressing step, and dimensionally stable articles or compacts are produced with minimal lateral stresses.

The invention will now be illustrated with reference to the following Examples which are not to be considered in any way limiting.

EXAMPLE 1

A Ag-W contact was made as follows. A blend of 35 wt% Ag with 65 wt% W was preheated in a hydrogen environment at 1,016° C. in order to provide an oxide clean surface on the particles, reduce the gas content of the mixture, and also to enhance the wetting between the Ag and W powders. The blend in the form of a cake was then granulated through a 20 mesh U.S. Sieve Series screen, to provide particles below 840 micrometers diameter, and reblended to ensure a homogeneous powder blend.

This powder was pressed at 564 kg/cm$^2$ (8,000 psi), into 0.5 cm wide×1.0 cm long×0.38 cm thick preforms, to form green compacts. The green density of the preform compact was 75%. A multiplicity of such preforms were then coated with a thin layer of graphite. A container pan consisting of a thick welded side type structure having walls 0.28 cm thick, with separate bottom and top covers of 0.058 cm thick steel sheet was also fabricated. This thick walled structure also had an evacuation tube welded onto one side.

The bottom sheet was then welded to the frame structure and the inside surfaces of the sheets were coated with graphite. Thirty-two compacts were arranged with no gaps between them within this frame, so as to completely fill the container pan. The coated top lid was placed on top of the pan and welded onto the pan frame. The pan was evacuated through the evacuation tube prior to final sealing. Upon sealing, the pan was ready for hot pressing.

For convenience, a hot isostatic press was used as the pressurizing mechanism. The containers were placed in a hot isostatic press work chamber, approximately 12.7 cm diameter×53.3 cm. long, and hot pressed at 960° C. for 5 minutes at 1,410 kg/cm$^2$ (20,000 psi). Upon completion of the thermal cycle, the container pan was removed from the hot press and cut open so that the compacts (contacts) fell apart. The contacts were subsequently cleaned by tumbling with detergent and water.

Contacts thus fabricated were analyzed with respect to dimensional stability, microstructure, density, hardness and electrical conductivity. The contacts showed a very homogeneous microstructure which would make them highly resistant to delamination after arcing. The contacts were all substantially the same size, exhibiting excellent dimensional stability since only pressure along their height axis was applied. The density of the contacts was found to be greater than 14.57 g/cc, that is, greater than 97.5% of theoretical density. Hardnesses were 73 on the Rockwell$_{30}$T scale.

EXAMPLE 2

In this example, 50 wt% Ag was blended with 50 wt% W and pre-treated in hydrogen at 977° C. in order to reduce the gas content and also to enhance the wetting between the silver and tungsten. The blend in the form of a cake was then granulated through a 20 mesh U.S. Sieve Series screen to provide particles below 840 micrometers diameter.

This powder was pressed at 705 kg/cm$^2$ (10,000 psi) into 3.6 cm long×0.93 cm wide×0.175 cm thick preforms. The green density of the preform compact was 70%. A multiplicity of such preforms were then coated with a thin layer of graphite. A shallow pan container consisting of 0.058 cm thick steel, approximately 0.15 cm deep was fabricated. A welded, stainless steel frame, such as that shown in FIG. 3 of the Drawings, 1.27 cm wide was placed within the pan next to the pan side walls, to act as a non-deformable frame. All the inside surfaces of the pan were then coated with graphite.

Compacts were then packed with no gaps between them, one layer deep, within the frame in the pan. Then the coated top lid was placed on top and the edges of the lid and the bottom pan were welded in an evacuated chamber. This container was then hot pressed through means of a hot isostatic press at a temperature of 960° C. and pressure of 1,551 kg/cm$^2$ (22,000 psi) for 5 minutes. Following the completion of the hot pressing cycle, the containers were sheared open, the contacts separated and tumbled with detergent and water. The contacts had a hardness of 57 on the Rockwell$_{30}$T scale and density of 98.5%. They all showed very homogeneous microstructure and were all substantially the same size.

We claim:

1. A method of forming a pressed, dense article comprising the steps:

(1) providing a compactable particulate combination;

(2) uniaxially pressing the particulate combination to a theoretical density of from 60% to 95%, to provide a consolidated article having the length and width desired in the final article but with the height larger than desired in the final article;

(3) placing at least one article in an open pan having a bottom surface and containing side surfaces that are not significantly pressure deformable, which side surfaces are parallel to the central axis of the pan, where the article is placed such that its height direction is parallel to the central axis of the pan, and where the article contacts a separation material which aids subsequent separation of the article and the pan;

(4) evacuating air from the pan and sealing the open top portion of the pan, where at least one of the top and bottom surfaces of the pan is pressure deformable;

(5) hot pressing the article through the sealed pan in the height direction of the article, where the pan side surfaces prevent significant lateral deformation of the article, at a pressure over 352.5 kg/cm$^2$ (5,000 psi), to provide simultaneous hot-pressing and densification of the entire article;

(6) cooling and releasing pressure on the article; and (7) separating the densified article from the pan.

2. The method of claim 1, where, the compactable particulate combination contains metal powder and where the combination is heated in a reducing atmosphere and then granulated to provide particles having a maximum dimension up to approximately 1,500 micrometers.

3. A high density article made by the method of claim 1.

4. A method of forming a pressed, dense, dimensionally predictable and reproducible metal compact, comprising the steps:

(1) mixing:

(a) powders selected from Class 1 metals consisting of Ag, Cu, Al, and mixtures thereof, with (b) powders selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof;

(2) uniaxially pressing the powders to a theoretical density of from 60% to 95%, to provide a compact having the length and width desired in the final compact but with the height larger than desired in the final compact;

(3) placing at least one compact in an open pan having a bottom surface, and containing side surfaces that are not significantly pressure deformable, which side surfaces are parallel to the central axis of the pan, where the compact is placed such that there are no significant gaps between the compact and the side surfaces, and the compact's height direction is parallel to the central axis of the open pan, and where the compact contacts a separation material which aids subsequent separation of the compact and the pan;

(4) evacuating air from the pan and sealing the open top portion of the pan, where at least one of the top and bottom surfaces of the pan is pressure deformable;

(5) hot pressing the compact through the sealed pan in the height direction of the compact, where the pan side surfaces prevent significant lateral deformation of the compact, at a pressure between 352.5 kg/cm$^2$ and 3,172 kg/cm$^2$, to provide simultaneous hot-pressing and densification of the entire compact to over 97% of theoretical density;

(6) cooling and releasing pressure on the compact; and (7) separating the compact from the pan.

5. The method of claim 4, where the powders are pressed in step (2) at from 35.25 kg/cm$^2$ to 2,115 kg/cm$^2$.

6. The method of claim 4, where the hot pressing in step (5) is from 1,056 kg/cm$^2$ to 2,115 kg/cm$^2$, and the temperature is from 0.5° C. to 20° C. below the melting point or decomposition point of the lower melting constituent present.

7. The method of claim 4, where the powder is selected from the group consisting of Ag+W; Ag+CdO; Ag+$SnO_2$; Ag+C; Ag+WC; Ag+Ni; Ag+Mo; Ag+Ni+C; Ag+WC+Co; Ag+WC+Ni; Cu+W; Cu+WC; and Cu+Cr.

8. The method of claim 4, where the powders are contacted with a brazeable metal strip prior to step (2).

9. The method of claim 4, where after step (1), the powders are heated in a gas selected from the group consisting of hydrogen gas, and dissociated ammonia at a temperature effective to provide an oxide clean surface on the powders except CdO, SnO, or $SnO_2$, if present, and more homogenous distribution of Class 1 metals, followed by granulation of the powder to where the particles have diameters up to approximately 1,500 micrometers.

10. The method of claim 9, where the powder, after granulation has a particle size in the range of from 200 micrometers to 1,000 micrometers.

11. The method of claim 4, where, in step (5), there is simultaneous collapse of the pan top and bottom surfaces and contact with the compacts, hot-pressing, and densification of the compacts to over 99.5% of theoretical density through the pressure transmitting container.

12. The method of claim 4, where there is no heating of the compacts before step (5), and a plurality of compacts are pressed in multiple layers.

13. The method of claim 4, where the compact height after step (2) is equal approximately to the desired, final compact height divided by the percentage of theoretical density of the compact after step (2).

14. The method of claim 4, where the pan is a shallow pan having thick side surfaces.

15. The method of claim 4, where the pan is a shallow pan having a separate, closely fitting frame, having an open top and bottom, next to the sides of the pan, which frame has essentially non-deformable sides.

16. The method of claim 4, where at least twelve compacts are placed in the pan in step (3).

17. The method of claim 4, where a plurality of sealed pans are stacked together and simultaneously hot pressed in step (5).

18. The method of claim 4, where an isostatic press is used in step (5).

19. The method of claim 4, where the closely fitting frame is made of a material selected from metal, ceramic, and graphite.

20. A high density contact made by the method of claim 4.

21. A method of forming pressed, dense, dimensionally predictable and reproducible compacts, comprising the steps:

(1) mixing:

(a) powders selected from Class 1 metals consisting of Ag, Cu, Al, and mixtures thereof, with (b) powders selected from the class consisting of CdO, SnO, $SnO_2C$, Co, Ni, Fe, Cr, $Cr_3C_2$, $Cr_7C_3$, W, WC, $W_2C$, WB, Mo, $Mo_2C$, Mob, $Mo_2B$, TiC, TiN, $TiB_2$, Si, SiC, $Si_3N_4$, and mixtures thereof;

(2) heating the powders in a reducing atmosphere, at a temperature effective to provide an oxide clean surface on the powders, except CdO, SnO, or $SnO_2$, if present, and more homogeneous distribution of Class 1 metals; (3) granulating the powders to where the powder particles have diameters up to approximately 1,500 micrometers;

(4) uniaxially pressing the powders to a theoretical density of from 60% to 95%, to provide compacts all having the length and width desired in the final compacts but all having a height larger than desired in the final compacts;

(5) placing a plurality of compacts in an open, shallow pan having a bottom surface, and containing sides and a separate, closely fitting frame, having an open top and bottom, next to the sides of the pan, which frame is not significantly pressure deformable, and which sides are parallel to the central axis of the open pan, where the compacts are placed such that there are no significant gaps between the compacts and the side surfaces, and all the compacts' height directions are parallel to the central axis of the open pan, and where the compacts contact a separation material which aids subsequent separation of the compacts and the pan;

(6) evacuating air from the pan and sealing the open top portion of the pan, where at least one of the top and bottom surfaces of the pan is pressure deformable;

(7) hot pressing the compacts through the sealed pan in the height direction of the compacts, where the frame prevents significant lateral deformation of the compacts, at a pressure between 352.5 $kg/cm^2$ and 3,172 $kg/cm^2$ and at a temperature from 0.5° C. to 100° C. below the melting point or decomposition point of the lowest melting component of the compacts, to provide simultaneous hot-pressing and densification of the entire surface of the compacts to over 97% of theoretical density;

(8) gradually cooling and releasing pressure on the compacts; and (9) separating the compacts from the pan.

22. The method of claim 21, where the powder, after step (3), has a particle size in the range of from 200 micrometers to 1,500 micrometers and where there is no heating of the compacts before step (7).

23. The method of claim 21, where the closely fitting frame is made of a material selected from ceramic and metal.

24. The method of claim 21, where a plurality of sealed pans are stacked on top of each other and simultaneously hot pressed in step (7).

25. A high density contact made by the method of claim 21.

* * * * *